US008096400B2

(12) United States Patent
Shuren et al.

(10) Patent No.: US 8,096,400 B2
(45) Date of Patent: Jan. 17, 2012

(54) SECURITY GATE MECHANISM FOR A CURRENCY HANDLING DEVICE

(75) Inventors: Thomas E. Shuren, West Chester, PA (US); Robert J. Clauser, Columbus, NJ (US)

(73) Assignee: MEI, Inc., West Chester, PA (US)

( * ) Notice: Subject to any disclaimer, the term of this patent is extended or adjusted under 35 U.S.C. 154(b) by 27 days.

(21) Appl. No.: 12/505,152

(22) Filed: Jul. 17, 2009

(65) Prior Publication Data

US 2011/0011699 A1 Jan. 20, 2011

(51) Int. Cl.
*G07D 11/00* (2006.01)

(52) U.S. Cl. ..... 194/351; 194/203; 194/349

(58) Field of Classification Search ..... 194/202, 194/203, 349, 351; 235/1 A, 483, 484, 485, 235/486, 495; 463/46, 47; 902/17; 221/21; 49/26, 27, 28

See application file for complete search history.

(56) References Cited

U.S. PATENT DOCUMENTS 1,515,922 A * 11/1924 Barnes ..... 232/1 E
4,602,724 A 7/1986 Bond et al.
5,577,589 A * 11/1996 Garcia ..... 194/204
5,628,258 A 5/1997 Zwahlen et al.
6,179,110 B1 1/2001 Ohkawa et al.
6,712,352 B2 3/2004 Bergeron et al.
6,991,083 B2 * 1/2006 Yoshioka et al. ..... 194/346

FOREIGN PATENT DOCUMENTS

EP 1 457 940 9/2004

OTHER PUBLICATIONS

European Search Report in European patent application No. 09168100.7 (Aug. 18, 2010).

* cited by examiner

*Primary Examiner* — Mark Beauchaine
(74) *Attorney, Agent, or Firm* — Pepper Hamilton LLP

(57) ABSTRACT

A security gate mechanism for a currency handling apparatus having a currency passageway includes a rotatable gate having a slit therein. The slit is aligned with the currency passageway when the rotatable gate is in an initial position. A drive wheel is coupled to the rotary gate for driving the rotatable gate in first and second directions, wherein the second direction is opposite the first direction. A positioning member is selectively engageable with the drive wheel for positioning the rotatable gate in the initial position such that the slit in the rotatable gate is substantially aligned with the passageway. The positioning member is arranged to be engageable with the drive wheel when the drive wheel rotates the rotatable gate in the second direction, but it is not engageable with the drive wheel when the drive wheel rotates the rotatable gate in the first direction.

24 Claims, 12 Drawing Sheets

SECURITY GATE MECHANISM FOR A CURRENCY HANDLING DEVICE

FIELD OF DISCLOSURE

The disclosure relates to a device for preventing unauthorized removal of currency from a currency handling apparatus. More particularly, the disclosure relates to a security gate mechanism to prevent removal of currency from within a currency handling apparatus.

BACKGROUND

Various machines and devices are known for accepting items of currency in exchange for goods and services. In devices that accept items of currency there is often a validation component for determining the type and validity of the inserted currency, for example a bill validator as known in the art. An example of a bill validator apparatus is disclosed in U.S. Pat. No. 6,712,352, which is incorporated herein by reference in its entirety. In some devices, there is a need to store the accepted currency that has been determined to be valid within the machine for either collection at a later time or for dispensing as part of a subsequent transaction. Storage of accepted currency often takes the form of a cashbox or currency storage container.

When a machine or device stores currency, there are often concerns with the security and accessibility of the stored currency to prevent theft. Various measures have been developed to minimize theft from such storage areas for example, locks or tamper evident markers. Systems also have been developed to prevent the extraction of an item of currency, for example a bill or banknote, once the machine has issued credit for the inserted bill.

An example of a system for preventing the extraction of a bill from a bill validation device is disclosed in issued U.S. Pat. No. 5,577,589. The system disclosed in U.S. Pat. No. 5,577,589 utilizes a rotary type gate to prevent a user from extracting an accepted banknote from a machine using a string attached thereto. Particularly, once the bill validator has accepted the banknote, a user may attempt to extract the accepted banknote using the attached string. However the rotary gate can be actuated so as to block the transportation path and thus prevent extraction of the banknote.

Another example of a device to prevent the extraction of a banknote from a bill validator using a rotary gate is disclosed in U.S. Pat. No. 6,179,110. The device disclosed in U.S. Pat. No. 6,179,110 utilizes a rotary type gate positioned along the transportation path of a banknote validator. In particular, the disclosed device has a driving device for rotating the rotary gate from a position allowing passage of a banknote there through to at least one position preventing passage of a banknote along the transportation path. Other features of the device disclosed in the foregoing patent include a bill validator with a rotator and driving device of the rotator which can be prevented from being damaged by inertial force of the rotator motor when the rotator is stopped in a position.

SUMMARY

Various aspects of the invention are set forth in the claims.

The disclosure relates to a currency handling apparatus. For the purposes of the disclosure currency includes, but is not limited to, bills, banknotes, security papers, documents, sheets, coins, tokens, certificates or coupons. The currency handling apparatus of the disclosure includes a passageway through which currency travels within the device. In some implementations, the passageway begins at an inlet where currency is inserted into the device, and passes through a validation section to an outlet. In some implementations, the currency handling apparatus includes a validation component, and a currency storage component. The validation component can include sensors for determining the type and validity of an inserted item of currency.

The validation component can be arranged to sense various features or aspects of an inserted currency item as commonly known in the art, for example reflection and/or transmission of light from a banknote. Other forms of validation techniques known in the art can be used as well.

The storage component can take the form of a cashbox as commonly known in the arts. In some implementations, the cashbox is a removable container arranged to store a plurality of items of currency (e.g., stacked banknotes) in an enclosure. The storage component can include a stacking mechanism integrated within the storage component for stacking currency therein. However, such a stacking mechanism need not be integrated into the cashbox itself in order to fall within the scope of the disclosure. The stored currency can be arranged within the storage component in a stacked (i.e., a face to face) relationship or in other manners such as in bulk or wound around a storage drum.

The currency handling device further includes a security gate mechanism operable to prevent unauthorized extraction (or removal) of an inserted currency item from within the device. The security gate includes a rotating gate structure operatively coupled to a drive wheel for actuating the rotary gate. In some implementations, the drive wheel is drivingly coupled to the rotating gate by a driving gear having teeth meshingly engaged with teeth formed on the rotating gate. In other implementations the drive wheel is drivingly engaged with the rotating gate by other driving means, for example a drive wheel, roller or belt.

The drive wheel is arranged so as to be capable of driving the rotating gate in a first direction (e.g., clockwise) or a second direction (e.g., counterclockwise) or both. In some implementations, the drive wheel is arranged to be coupled to the actuation mechanism of the stacker mechanism. In such an implementation the rotating gate is actuated by the drive wheel when the stacker mechanism is actuated. In other implementations the drive wheel is an independent component and is controlled to perform the necessary functions of the security gate mechanism.

The rotating gate includes a slit that is aligned with the passageway of the currency handling device when the rotating gate is in an initial position. The slit in the rotating gate is configured so as to be capable of allowing items of currency to travel through the rotating gate when in the initial position. In some implementations, the slit formed in the rotating gate is of certain dimension so that a banknote can pass through; however, other dimensions and configurations can be used as well.

In some implementations, the security gate mechanism includes a positioning member selectively engagable with the drive wheel for positioning the rotating gate in the initial position. In some implementations the positioning member is slidingly moveable between a blocking position and a non blocking position. The positioning member can be biased in a direction urging contact between the drive wheel and the positioning member. In other implementations the positioning member can be pivotally movable between a blocking position and a non-blocking position. In some implementations, the drive wheel includes an engaging surface for engagement with the positioning member. In some implementations, the engaging surface is a variable cam surface having an abutment surface for engaging the positioning member such that the rotating gate can be positioned in an initial position.

The security gate mechanism can be configured so as to allow the rotating gate to rotate in a first direction (e.g., clockwise) while the positioning member slidingly moves along a cam type engagement surface. As the security gate mechanism is actuated, the rotating gate continues to rotate in a first direction. In some implementations, the actuation of the security gate can cause the rotating gate to move in a first direction through multiple full rotations or a portion of a full rotation. As the rotating gate rotates in a first direction, the positioning member is displaced between a blocking position and a non-blocking position and back to a blocking position.

In some implementations, the rotating gate further includes a sensing feature formed on the peripheral edge and operatively engagable with a sensing mechanism. In some implementations, the sensing feature is configured as a recess at a periphery of the rotating gate. In other implementations, the sensing feature is configured as a protrusion at a periphery of the rotating gate. The sensing feature coupled with the sensing mechanism allows for the position of the rotating gate to be measured and or monitored.

In some implementations, the sensing mechanism includes a sliding member operatively coupled to the rotating gate. The sliding member can include a sensor coupling member (e.g., a prism) operatively coupled to a sensor for sensing the position of the sliding member, and thus sensing whether the rotating gate in the initial position or not. In some implementations, a prism is arranged so as to complete a light path between a source and detector of the sensing mechanism when the rotating gate is in the initial position. Alternatively, the sensing mechanism senses the rotating gate in the initial position when the sensor coupling member blocks the light path between a source and detector of the sensing mechanism.

Other features and advantages will be apparent from the following detailed description and the accompanying drawings, and from the claims.

DETAILED DESCRIPTION

Figure 1:
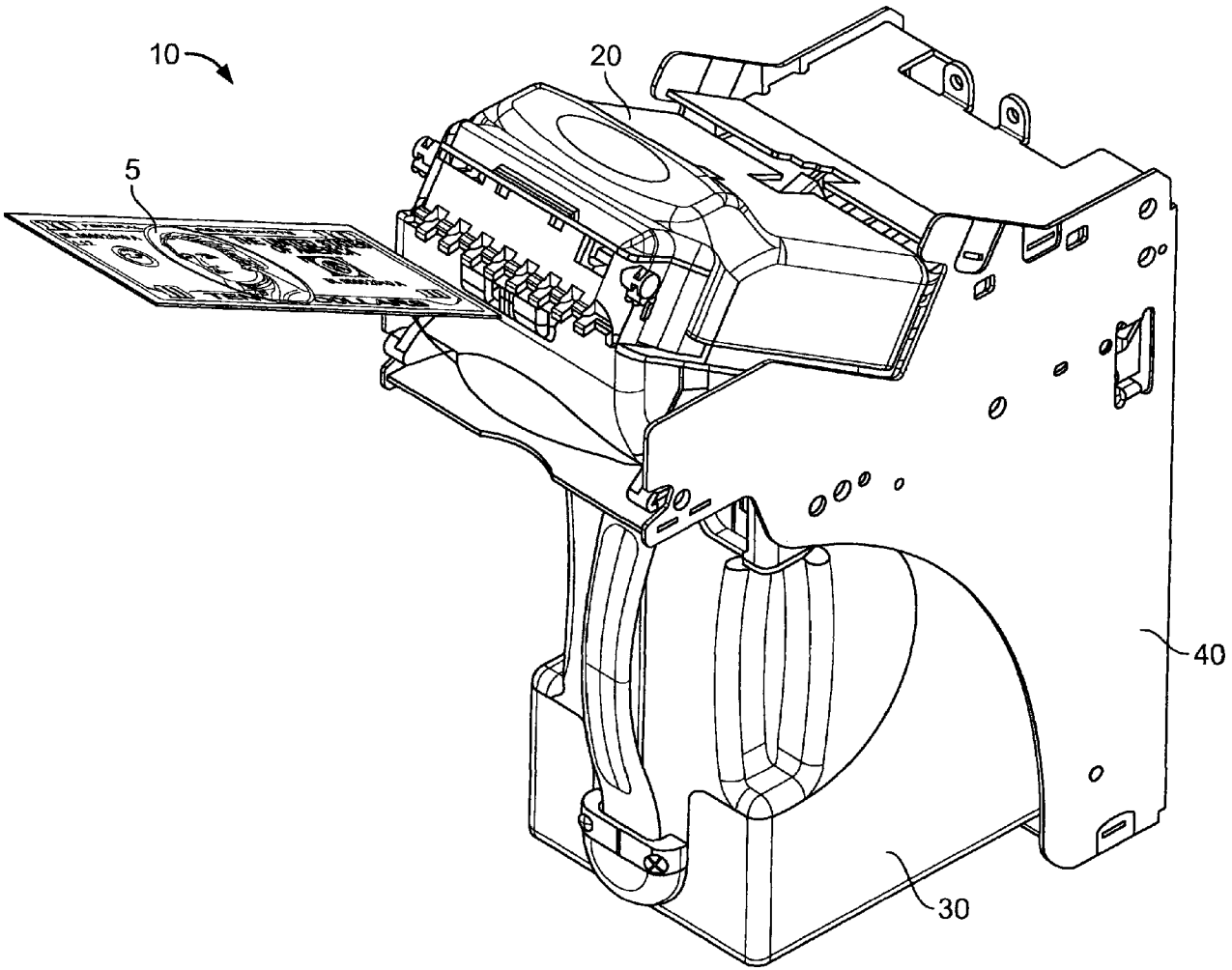
FIG. 1 illustrates an example of a currency handling apparatus.
Figure 2:
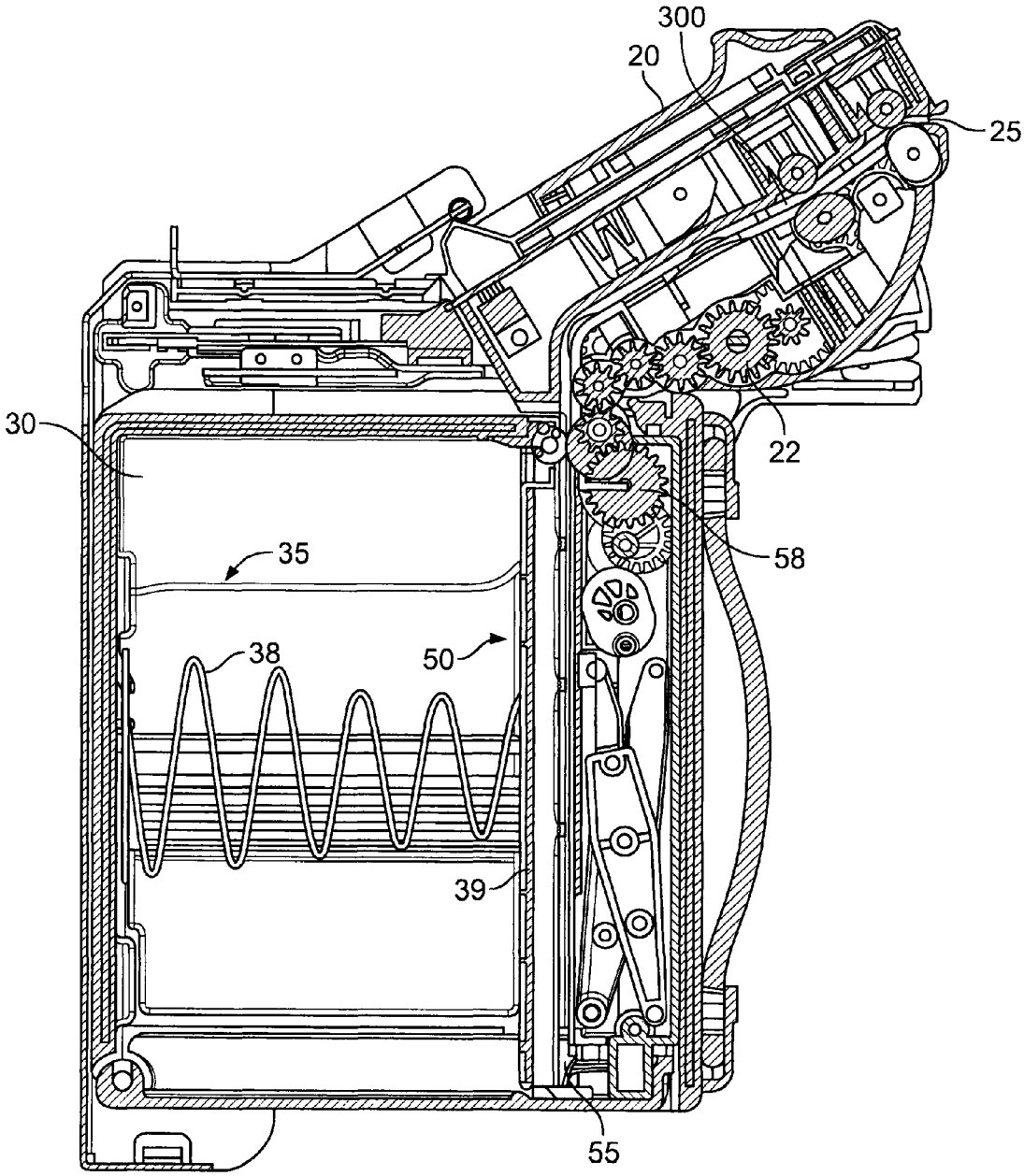
FIG. 2 illustrates the interconnection of various components of a currency handling apparatus.
Figure 3:
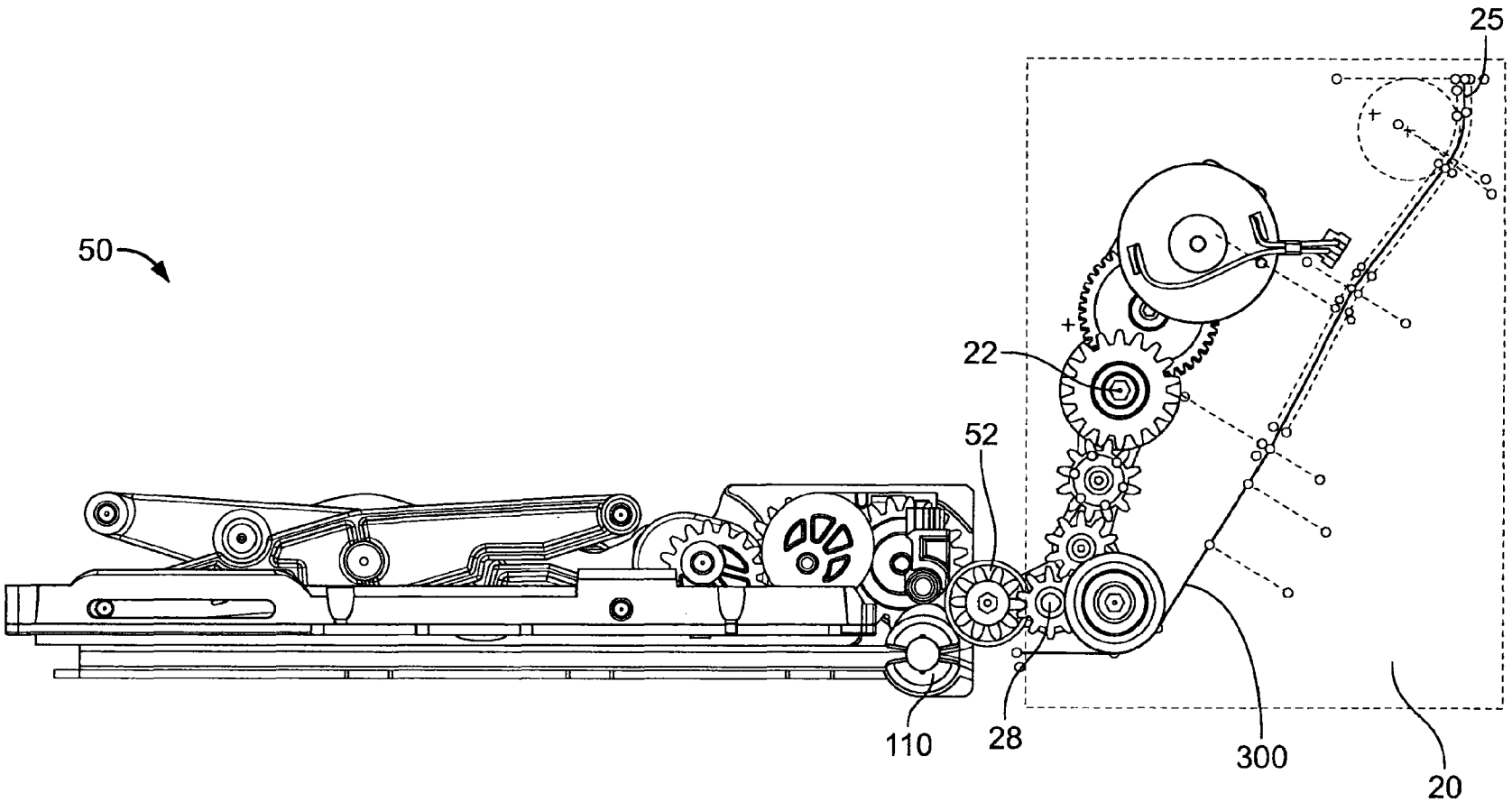
FIG. 3 illustrates an example of the coupling of a validation unit and stacking mechanism according to the invention.
Figure 4:
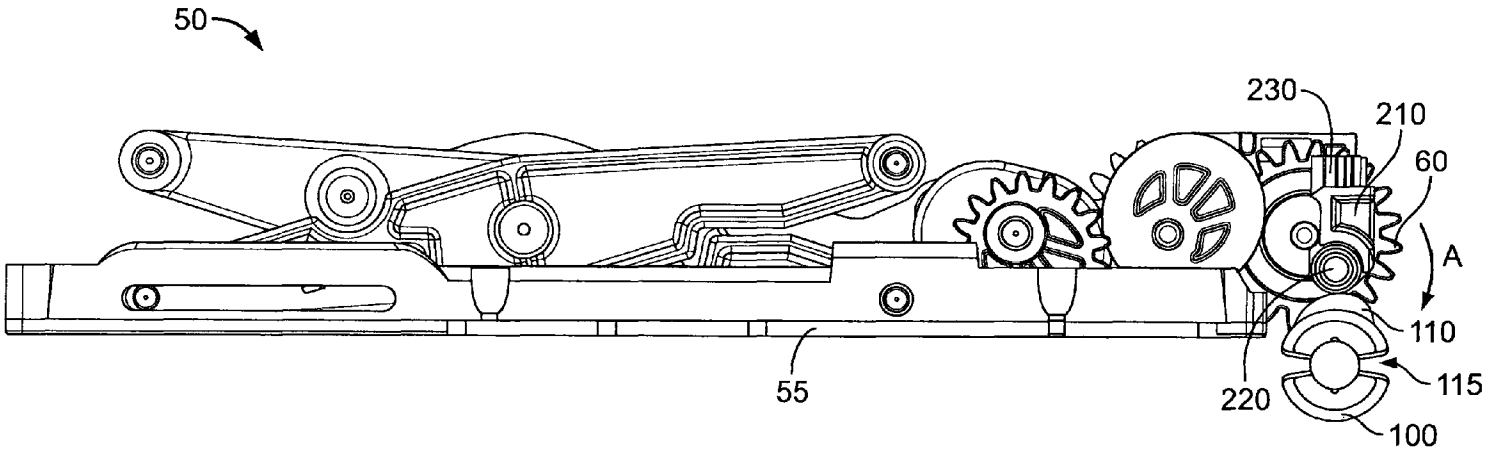
FIG. 4 illustrates an example of the security gate mechanism interconnected with a stacking mechanism in an initial position according to the invention.
Figure 5:
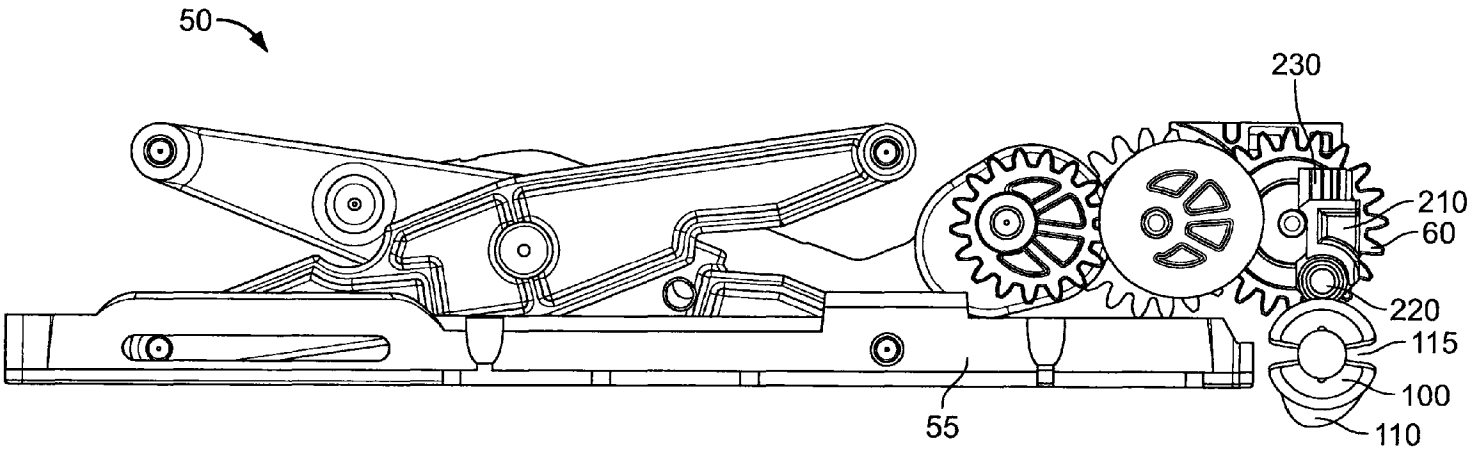
FIG. 5 illustrates the stacking mechanism and security gate mechanism, including the sensing system after actuation of the drive wheel in a first direction.
Figure 6:
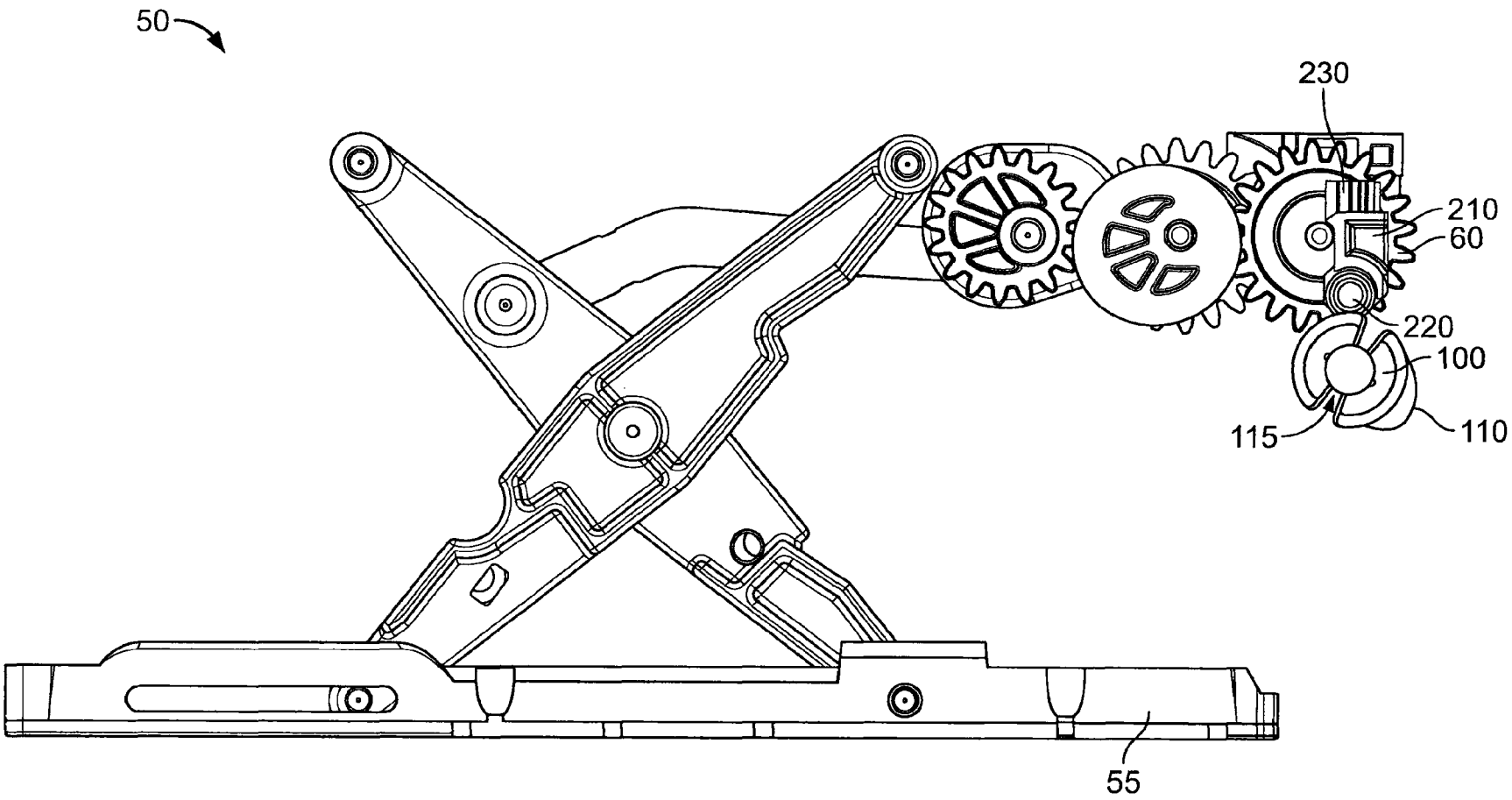
FIG. 6 illustrates the stacking mechanism extended during a stacking motion.

As illustrated in the example of FIGS. 1-3, a currency handling apparatus 10 includes a validation module 20, a removable storage unit 30, passageway 300, and a chassis 40. In some implementations validation module 20 is removably coupled to chassis 40. Validation module 20 can be configured to receive a item of currency 5 at inlet 25 and transport currency item 5 past a sensing component to determine the type and validity of currency item 5. In some implementations, validation module 20 further includes a transportation mechanism (not shown) for transporting currency item 5 through the validation module.

In some implementations, storage unit 30 includes a stacking mechanism 50 operatively coupled to a stacking drive assembly 22 of validation module 20. In other implementations, stacking mechanism 50 is arranged such that it is a separate component from storage unit 30. Stacking mechanism 50 can be configured, for example, as a plunger type stacking mechanism as is commonly known in the art. Other configurations of stacking mechanism 50 can be used as well. In the illustrated example, stacking mechanism 50 includes actuation assembly 58, which includes a drive train including a series of gears and which includes plunger extension means 59 including a scissor arrangement pivotally and slidingly coupled to plunger 55. Actuation assembly 58 includes a stacker coupling gear 52 for meshing engagement with a validator unit coupling gear 28 of stacking drive assembly 22.

In the illustrated example, currency storage unit 30 include a pressure plate 39 and biasing spring 38 for storing items of currency in a stacked (e.g., face to face) relationship within a cavity 35 defined by the perimeter of storage unit 30. Storage unit 30 can be configured for removable coupling to chassis 40 as known in the art.

Currency handling unit 10 includes a security gate mechanism. As illustrated in the example of FIG. 3, the security gate mechanism includes rotating gate 100 with a slit 115 there through, and further includes drive wheel 60 operatively coupled to rotating gate 100. In some implementations, drive wheel 60 is configured as a toothed gear for meshing engagement with rotating gate 100. In other implementations, drive wheel 60 is coupled to rotating gate 100 using a belt configuration or through rolling contact. In some implementations, drive wheel 60 is further coupled to actuation assembly 58. In other implementations, drive wheel 60 is driven and controller by a separate and independent actuator (e.g., a drive motor). Such an implementation allows for the security gate mechanism to be implemented at any position along passageway 300 for a desired application.

As illustrated in FIGS. 4-6 and 12-15, the security gate mechanism can include a position sensing system 200 for monitoring and determining the position of rotating gate 100. In some implementations, rotating gate 100 includes a sensing feature 110 on its periphery. As shown in the illustrated example, position sensing system 200 includes a sliding member 210 operatively coupled to rotating gate 100 by roller 220. Roller 220 is arranged for rolling contact with a periphery of rotating gate 100 so as to be displaced by sensing feature as rotating gate 100 rotates. In some implementations, the position sensing system 200 is operatively coupled to rotating gate 100 via sliding contact or an electrical flag such as an encoder.

Figure 12:
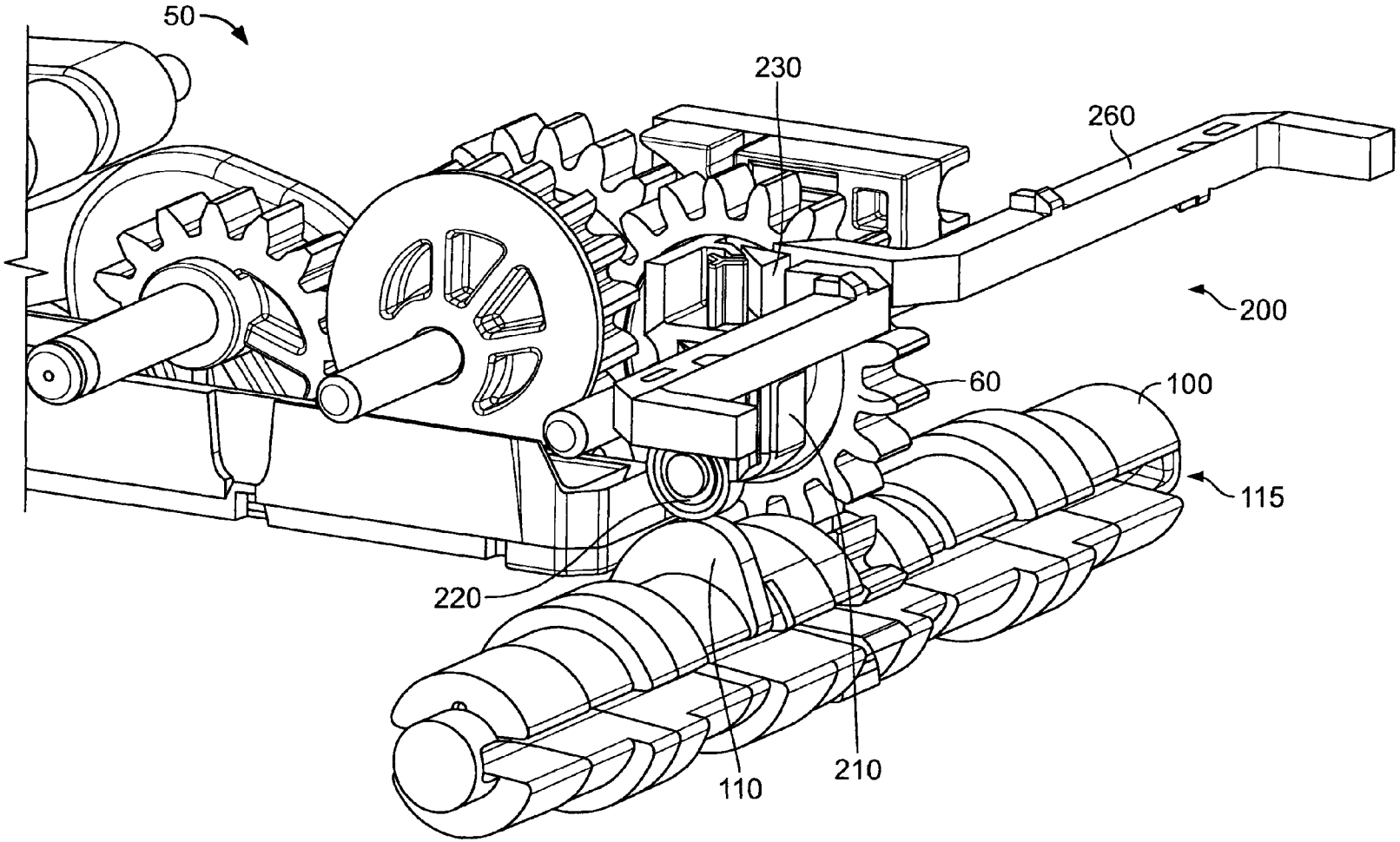
FIG. 12 illustrates an example of a position sensing system when the rotating gate is in its initial position.
Figure 13:
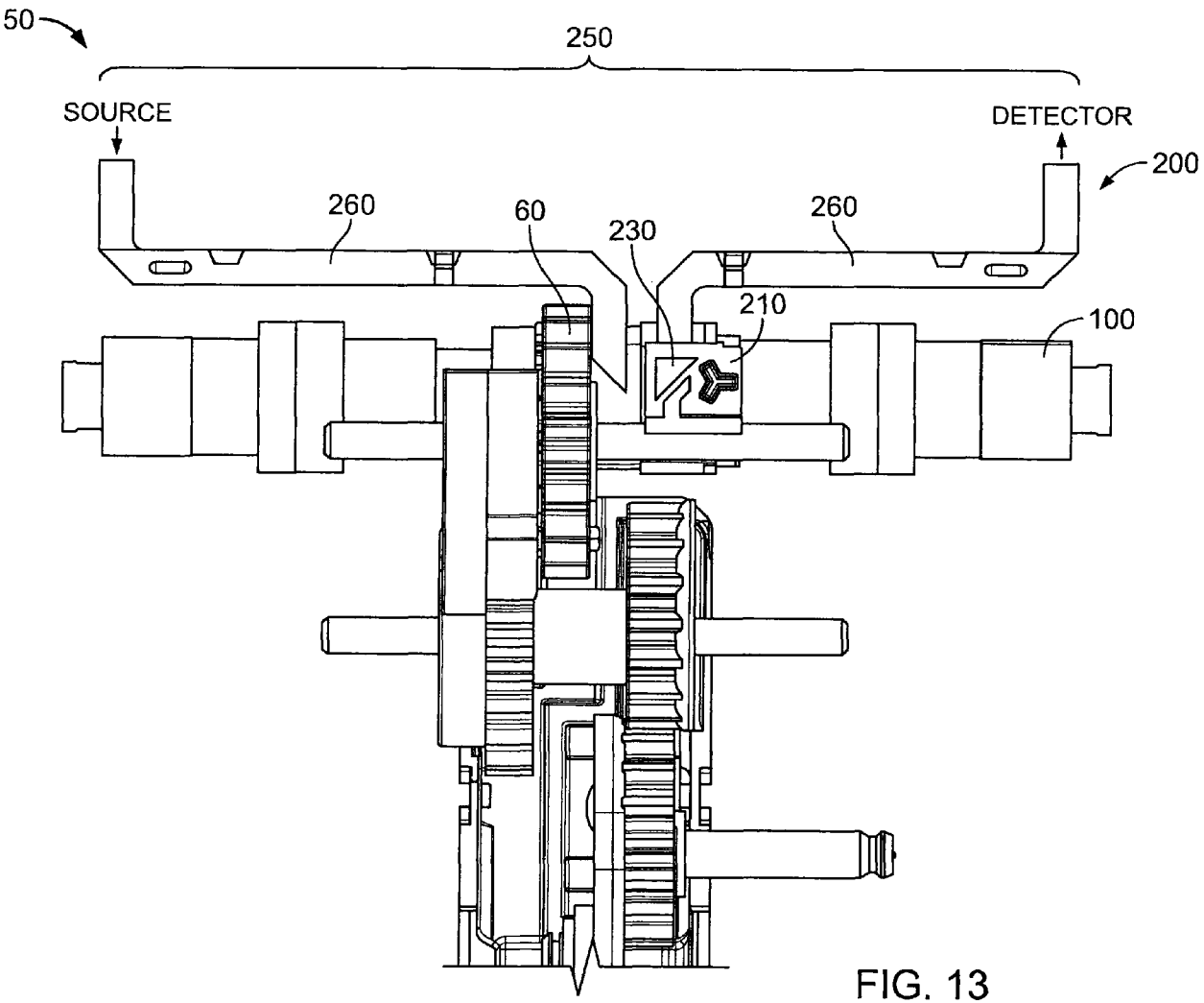
FIG. 13 illustrates further details of the position sensing system of FIG. 12.
Figure 14:
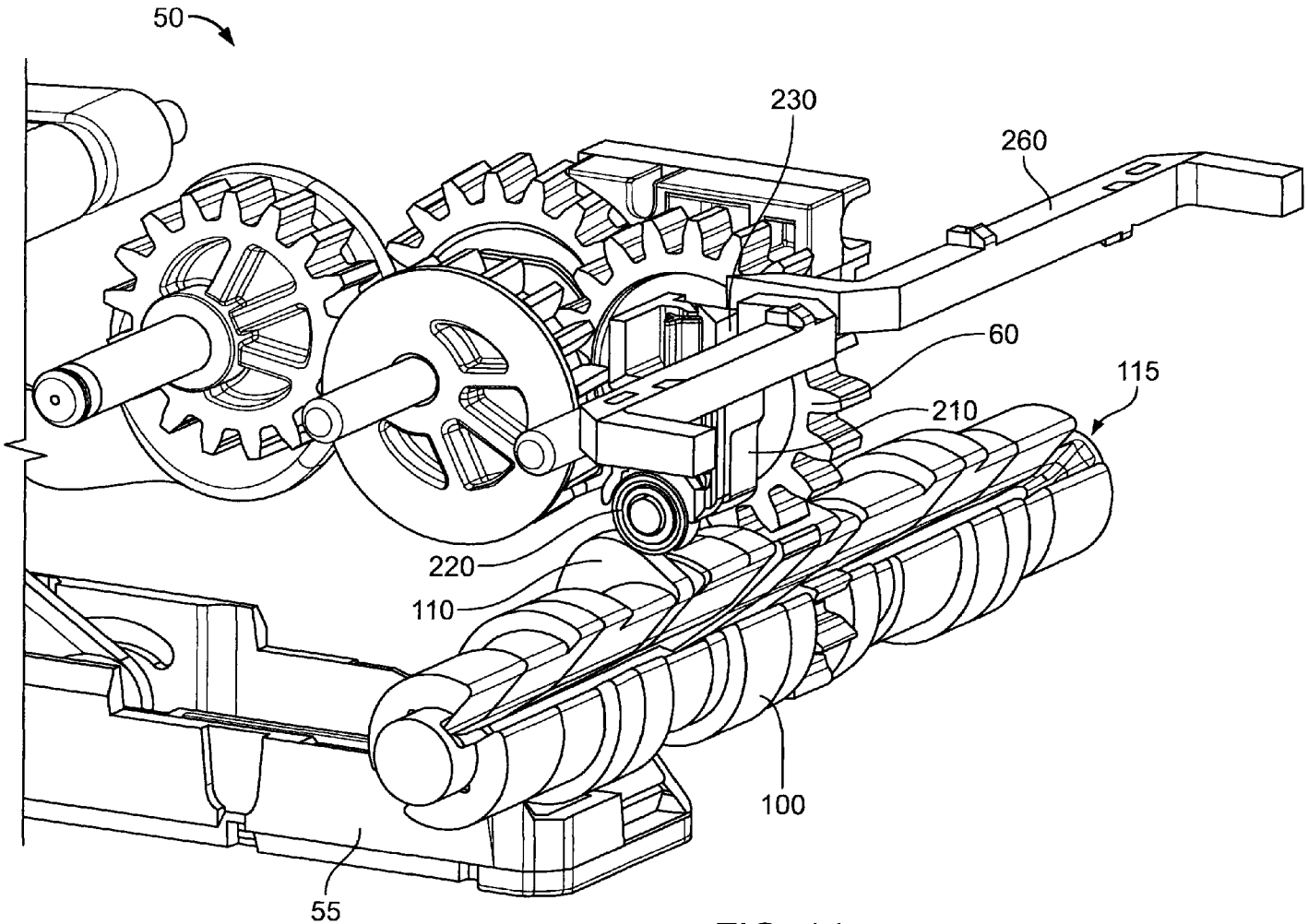
FIG. 14 illustrates the position sensing system when the rotating gate is in a subsequent position.

In the illustrated example, sliding member 210 of sensing system 200 further includes a sensor coupling component 230 for operative coupling with a position sensor 250 of sensing system 200. In some implementations, sensor coupling component 230 is a portion of a light pipe 260 operatively coupling position sensor 250 with sensor coupling component 230. Sensor 250 can be arranged to include a source at first end of light pipe 260 and a detector at a second end of light pipe 260 as shown in FIG. 13. Sensor coupling component 230 is arranged at a far end of sliding member 210 relative to roller 220 so that a light path is completed between the source and the detector when rotating gate 100 is in an initial position as shown in FIG. 12. In other implementations, sensor coupling component 230 and sensor 250 can be arranged to form a Hall effect sensing system.

In the example illustrated in FIGS. 7-11, the security gate mechanism further includes a positioning member 80 for selective engagement with drive wheel 60. In some configurations, the security gate mechanism further includes a positioning gear 150 operatively coupled between drive wheel 60 and positioning member 80. Drive wheel 60 can include a compound gear 62 located thereon for meshing engagement with positioning gear 150. Use of a compound gear 62 for coupling drive wheel 60 and positioning gear 150 is an example to attain a desired gear ratio; however, positioning gear 150 and drive wheel 60 can be coupled through standard meshing engagement of gears. In the illustrated example, positioning gear 150 includes a variable cam surface 155 and positioning gear abutment surface 158 operatively coupled with positioning member 80. Positioning member 80 includes a cam follower surface 82 and locator abutment surface 86. The positioning member 80 is biased in a direction towards variable cam surface 155 via biasing spring 85. In other implementations, positioning member 80 is pivotally configured so as to engage drive wheel 60.

The operation of currency handling apparatus 10 and the security gate mechanism is now described. An item of currency 5 is inserted into currency handling apparatus 10 at inlet 25 (see FIG. 1). The transportation mechanism (not shown) of validation module 20 transports currency item 5 past a sensing component (not shown) to determine the type and validity of currency item 5. Once a determination of validity of currency item 5 is made by validation module 20, the transportation mechanism of validation module 20 continues to transport currency item 5 along passageway 300, through slit 115 of rotating gate 100, and into a position adjacent stacking mechanism 50. Once currency item 5 is located in a position adjacent stacking mechanism 50, stacking drive assembly 22 (see FIG. 3) is actuated to stack currency item 5 into storage unit 30 as is described in more detail below.

Actuation of stacking drive assembly 22 causes validator unit coupling gear 28 to rotate. Rotation of validator coupling gear 28 causes complementary rotation of stacker coupling gear 52 as a result of the meshing engagement between the gears. Stacker coupling gear 52, through meshing engagement with drive wheel 60, causes rotation of member 60 in a first rotational direction A. Through meshing engagement of positioning gear 150 with step gear 62 of drive wheel 60, positioning gear 150 rotates in a direction indicated by X, which is opposite to direction A.

Figure 7:
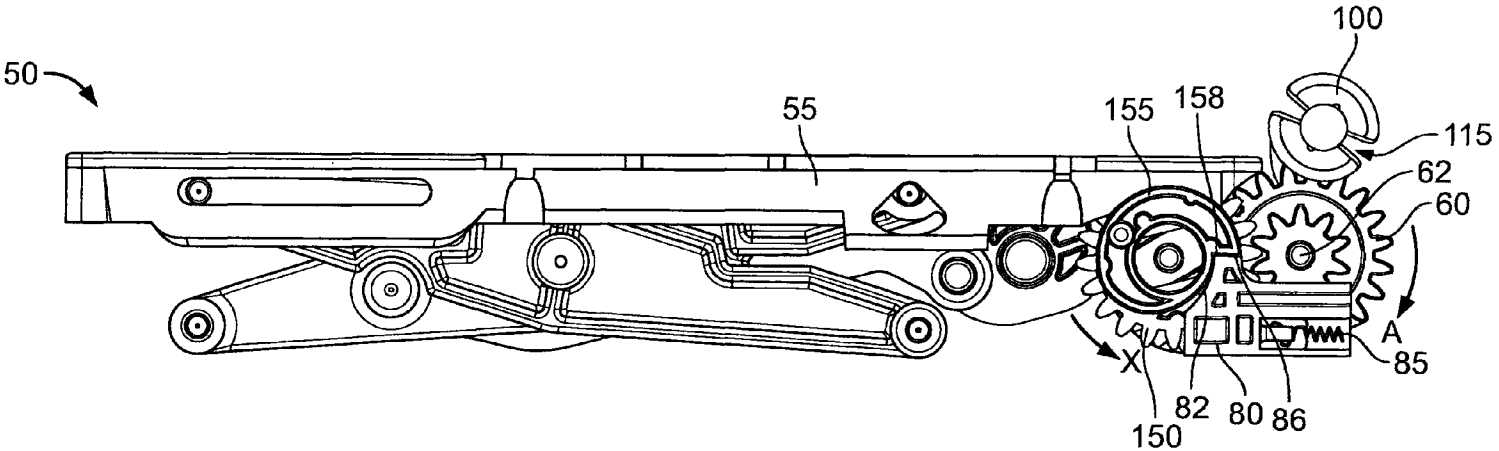
FIG. 7 illustrates the stacking mechanism and security mechanism in an initial position.
Figure 8:
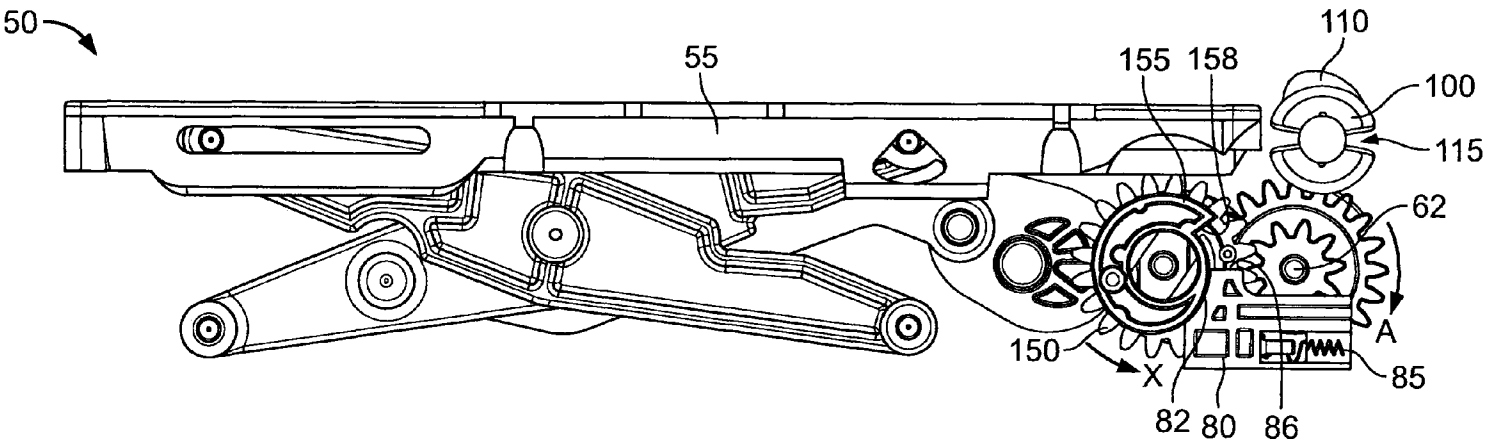
FIG. 8 illustrates the security mechanism after actuation of drive wheel in a first direction.

Prior to actuation of stacker driving assembly 22, positioning gear 150 and rotating gate 100 are positioned in an initial position as shown in FIG. 7. In the initial position, positioning member 80 is positioned in a blocking position whereby positioning gear abutment surface 158 and locator abutment surface 86 are in abutment. As drive wheel 60 begins to rotate in direction A, complementary rotation of positioning gear 150 begins to rotate in direction X thereby moving positioning gear abutment surface 158 and locator abutment surface 86 out of abutment. Additionally, as positioning gear 150 rotates in direction X, positioning member 80 slides along cam surface 155 at cam follower surface 82. Movement of positioning gear 150 causes cam surface 155 to slide relative to cam follower surface 82. As a result of the variable radius of positioning gear cam surface 155, positioning member 80 begins to be displaced linearly relative to the rotational axis of positioning gear 150 and thus begins to move out of a blocking position. Movement of positioning member 80 from a blocking position to a non-blocking position compresses a biasing member 85.

Figure 9:
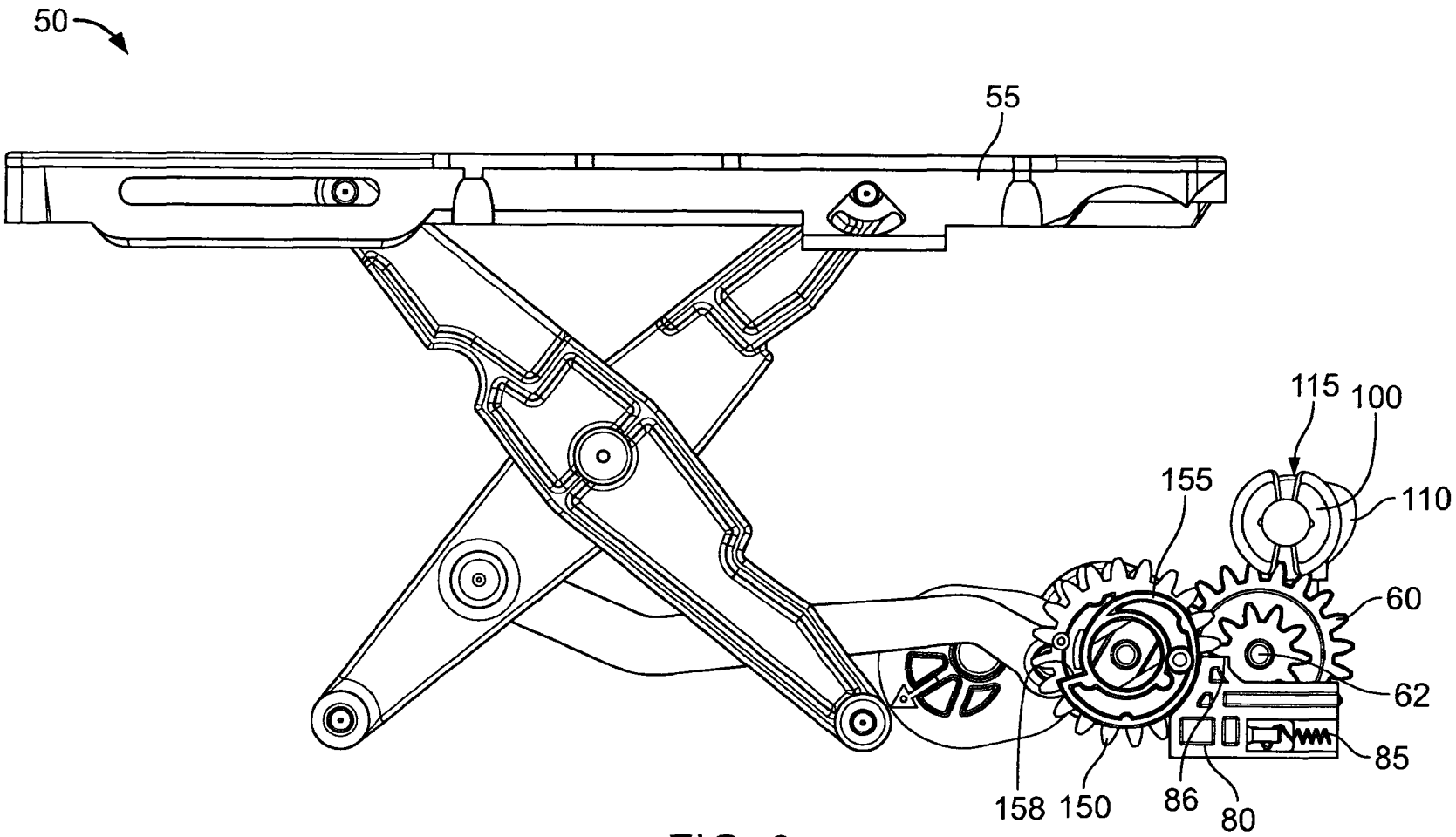
FIG. 9 illustrates the security mechanism when the stacking mechanism is in an extended position during a stacking cycle.

In conjunction with the rotation of drive wheel 60, the meshing engagement of rotating gate 100 with drive wheel 60 causes gate 100 to rotate. Prior to actuation of stacking drive assembly 22, rotating gate 100 is positioned in an initial position whereby slit 115 is aligned with passageway 300 such that an item of currency can pass there through. As drive wheel 60 causes rotation of rotating gate 100 (see FIG. 8), slit 115 moves from an initial position allowing passage of a currency item, to a position whereby slit 115 is no longer aligned with passageway 300 (FIG. 9).

In some implementations, drive wheel 60 is meshingly engaged with rotating gate 200 having gear teeth arranged at a far end of the body of rotating gate. In other implementations, as shown in the figures, the gear teeth of rotating gate 100 are arranged within the body of rotating gate 100 in a manner whereby slit 115 bisects the circumference of the toothed pattern of rotating gate 100.

Figure 10:
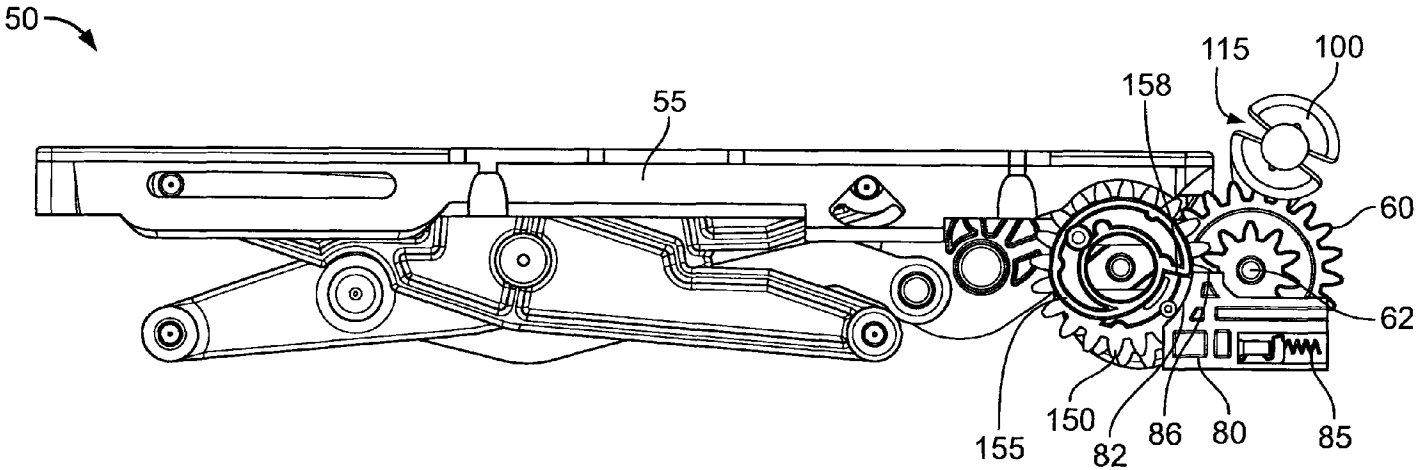
FIG. 10 illustrates the positioning member in a non-blocking position.
Figure 11:
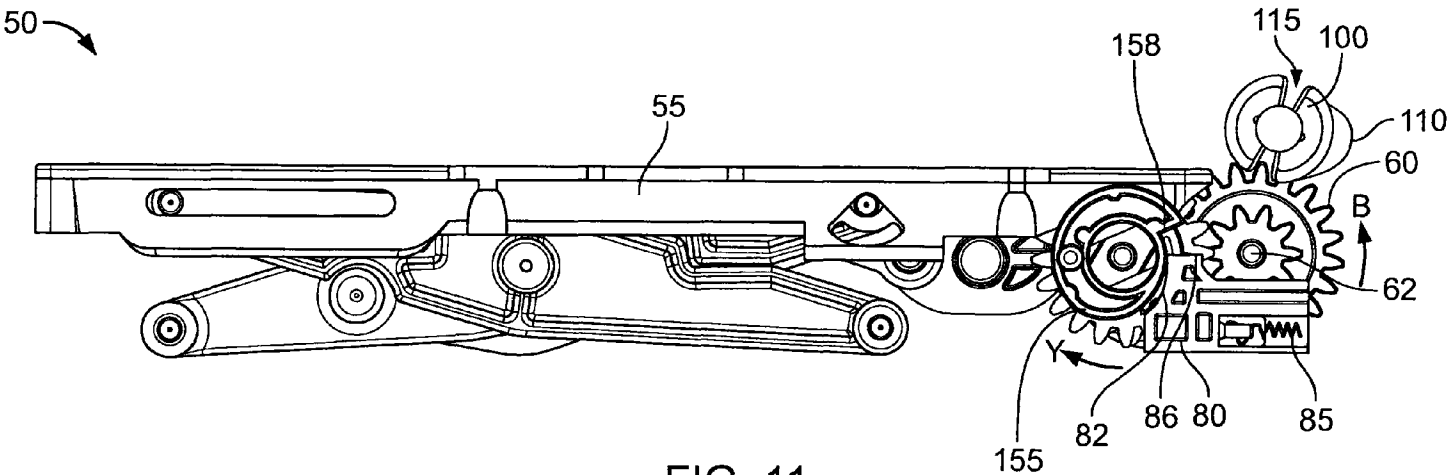
FIG. 11 illustrates the security mechanism in a position having the positioning member in a blocking position and indicating the second direction of motion to return the rotating gate to an initial position.

Continued actuation of stacking drive assembly 22, and thus rotation of positioning gear 150, causes cam surface 155 to continue to slide past and along cam follower surface 82 and further displacing positioning member 80 from a blocking position. Because the security gate mechanism in integrated into stacker mechanism 50 in the illustrated example, rotating gate 100 will continue to rotate in the first direction as plunger 55 cycles through the stacking motion. As plunger 55 approaches the return position, positioning gear abutment surface 158 approaches locator abutment surface 86 as shown in FIG. 10. As plunger 55 returns to a home position, positioning member 80 returns to a blocking position as shown in FIG. 7. Stacking drive assembly 22 continues to rotate positioning gear 150 in direction X past the initial position allowing positioning member 80 to return to a blocking position. At this point stacking drive assembly 22 is stopped from rotating positioning gear 150 in the first direction X resulting in a separation between positioning gear abutment surface 158 and locator abutment surface 86 as shown in FIG. 11.

To position rotating gate 100 back into the initial position, stacking drive assembly 22 is actuated in a reverse direction resulting in rotation of drive wheel 60 in a second direction B, which is opposite the first direction A. As a result of operating stacking drive assembly 22 in a reverse direction, positioning gear 150, via meshing engagement with drive wheel 60, also rotates in a second direction Y, opposite of the first direction X. Rotation of positioning gear 150 in a second direction Y causes positioning gear abutment surface 158 and locator abutment surface 86 to come into abutment at the initial position. Concurrently, due to the meshing engagement of rotating gate 100 with driving gear 60, rotating gate 100 also rotates in a second direction (i.e., reverse or opposite the first direction). Therefore once abutment between surfaces 158 and 86 is achieved, rotating gate 100 has been returned to an initial position whereby slit 115 is again aligned with passageway 300.

Figure 15:
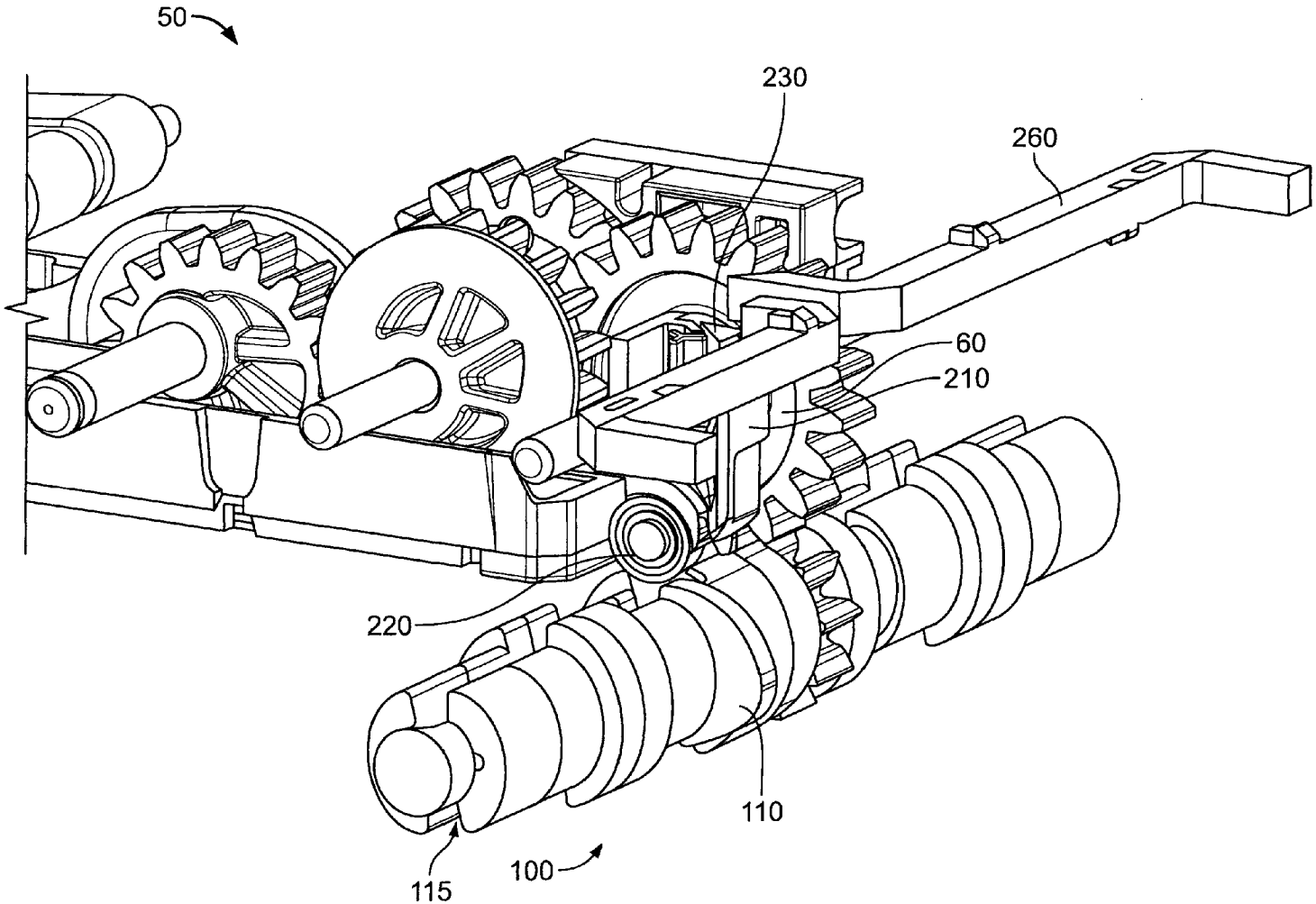
FIG. 15 illustrates the position sensing system when the rotating gate is in yet another position.

The operation of position sensing system 200 is described next. Starting from the initial position with rotating gate 100 aligned with passageway 300, sliding member 210 and roller 220 are in rolling contact with sensing feature 110 as shown in FIG. 12. In implementations in which sensing feature 110 is a protrusion at the periphery of rotating gate 100, roller 220 and sliding member 210 are displaced linearly relative to the rotation axis of rotating gate 100. As stacking drive assembly 22 is actuated in a first direction A, rotating gate 100 begins complementary rotation in a first direction. As rotating gate 100 rotates, roller 220 moves along and the surface of sensing feature 110 allowing linear displacement of sliding member 210 in a direction towards the periphery surface of rotating gate 100 (via a sensing biasing member) as shown in FIG. 12 and FIG. 13. When roller 220 is no longer in contact with sensing feature 110, sliding member is urged towards rotating gate 100 and held in an extended position by a physical stop (e.g., a travel limit) preventing further movement towards rotating gate. The physical stop prevents roller 220 from contacting the remaining periphery of rotating gate 100 once roller 220 and sensing feature 110 are no longer in contact, as shown in FIG. 15. Continued rotation of rotating gate 100 allows roller 220, and thus sliding member 210, to remain in an extended position relative to the initial position, until sensing feature 110 again comes into rolling contact with roller 220.

When sliding member 210 is in a position contacting sensing feature 110, sensor coupling component 230 is in a position completing the light path of light pipe 260 such that sensor 250 senses that slit 115 is in a position aligned with passageway 300. In some implementations, during a full stacking cycle of stacking mechanism 50, sensing system 200 may sense rotating gate 100 becoming aligned with passageway 300 multiple times. The number of rotations rotating gate 100 moves through depends on specific configurations (e.g., gear train ratios) of actuation assembly 58.

In the forgoing implementations, the security gate mechanism has been described as an integrated unit of stacking mechanism 50. However the security gate mechanism can be configured as a separate unit operatively coupled to passageway 300 at any point to facilitate the prevent of a fraudulent attempt to remove an item of currency from currency handling apparatus 10. For example security gate mechanism can be configured to be driven by an actuator (not shown) operatively coupled to driving gear 60 and controlled separate from other transportation event and and/or stacking events of currency handling apparatus 10. An advantage of the disclosed security gate mechanism is that attempts to fraudulently remove a currency item 5 from handling apparatus 10 (e.g., by a string attached thereto) can be prevented by actuating drive gear 60 so as to rotate rotating gate 100 resulting in any string attached to currency item 5 becoming wound around rotating gate 100. If an attempt to remove a currency item 5 having a string attached thereto occurs, reverse rotation of rotating gate 100 will be prevented by the abutment between positioning member 80 and drive wheel 60 as described herein.

In the implementations described above, the position sensing system 200, the security gate mechanism, and the stacking mechanism 50 are actuated simultaneously as a result of the security gate mechanism being integrated and actuated by stacking drive assembly 22. In other implementations, the security gate mechanism can be actuated and controlled independently of stacking mechanism 50, stacking drive assembly 22, or the position sensing system. An example of currency handling apparatus 10 having an independently actuated and controlled security gate mechanism is a stackerless configuration in which currency handling apparatus 10 does not have a currency storage unit 30 for stacking accepted currency. In such an apparatus, the security gate mechanism is integrated into apparatus 10 such that it is arranged along passageway 300.

An additional feature of the security gate mechanism is that if a "fishing" element is attached to an item of currency inserted into currency handling apparatus, the presence of the "fishing" element can be recognized when rotating gate 100 rotates. If the "fishing" element is a string attached to the currency item, rotation of rotating gate 100 causes the string to become wound around rotating gate 100. If the "fishing" element is a more rigid substance (e.g., tape or thin plastic sheet), rotation of rotating gate will impact the "fishing" element and cause the current required to continue rotation of rotating gate 100 will exceed predetermined thresholds (e.g., current draw limits) and thus signal that an element is present in passageway 300.

Other implementations are within the scope of the claims.

What is claimed is:

1. A security gate mechanism for a currency handling apparatus having a currency passageway comprising:

a rotatable gate having a slit therein, wherein the slit is aligned with the currency passageway when the rotatable gate is in an initial position;

a drive wheel comprising a toothed gear having a step gear incorporated thereon, wherein the drive wheel is coupled to the rotatable gate for driving the rotatable gate in first and second directions, and wherein the second direction is opposite the first direction; and a positioning member selectively engageable with the drive wheel for positioning the rotatable gate in the initial position such that the slit in the rotatable gate is substantially aligned with the passageway;

wherein the positioning member is arranged to be engageable with the drive wheel when the drive wheel rotates the rotatable gate in the second direction and not engageable with the drive wheel when the drive wheel rotates the rotatable gate in the first direction.

2. A security gate mechanism according to claim 1 further comprising a positioning gear meshingly coupled with the drive wheel and including a positioning cam surface thereon.

3. A security gate mechanism according to claim 2 wherein the positioning member includes a cam follower surface for sliding engagement with the positioning cam surface of the positioning gear.

4. A security gate mechanism according to claim 3 wherein the positioning cam surface is a variable radius surface relative to a rotational axis of the positioning gear.

5. A security gate mechanism according to claim 4 wherein the positioning member is moved from a blocking position to a non-blocking position when the positioning gear is rotated in the first direction.

6. A security gate mechanism according to claim 3 wherein the positioning cam surface further includes a positioning gear abutment surface.

7. A security gate mechanism according to claim 6 wherein the positioning member further includes a positioning member abutment surface.

8. A security gate mechanism according to claim 7 wherein the rotatable gate is positioned in the initial position when the positioning gear abutment surface and the positioning member abutment surface are in abutment.

9. A security gate mechanism according to claim 7 wherein the rotatable gate is positioned in the initial position by movement of the positioning gear in a second direction whereby the positioning gear abutment surface and the positioning member abutment surface are brought into abutment.

10. A security gate mechanism according to claim 1 wherein the rotatable gate further includes a sensing feature located about a periphery of the rotatable gate.

11. A security gate mechanism according to claim 10 further comprising a position sensing system.

12. A security gate mechanism for a currency handling apparatus having a currency passageway comprising:

a rotatable gate having a slit therein, wherein the slit is aligned with the currency passageway when the rotatable gate is in an initial position, the rotatable gate further including a sensing feature located about a periphery of the rotatable gate;

a drive wheel coupled to the rotatable gate for driving the rotatable gate in first and second directions, wherein the second direction is opposite the first direction;

a positioning member selectively engageable with the drive wheel for positioning the rotatable gate in the initial position such that the slit in the rotatable gate is substantially aligned with the passageway, wherein the positioning member is arranged to be engageable with the drive wheel when the drive wheel rotates the rotatable gate in the second direction and not engageable with the drive wheel when the drive wheel rotates the rotatable gate in the first direction, and a position sensing system, wherein the position sensing system includes a sliding member and a roller for operative coupling with the rotatable gate and the sensing feature.

13. A security gate mechanism according to claim 12 wherein the position sensing system further includes a sensor coupling component located at a far end of the sliding member relative to the roller.

14. A security gate mechanism according to claim 13 wherein the position sensing system further includes a sensor for monitoring the position of the rotatable gate.

15. A security gate mechanism according to claim 14 wherein the position sensing system senses that the rotatable gate is in a position, whereby the slit is aligned with the passageway, when the roller is in rolling contact with the sensing feature.

16. A security gate mechanism according to claim 15 further including a light pipe operatively coupled between the sensor and the sensor coupling component.

17. A security gate mechanism according to claim 16 wherein the sensor coupling component completes a light path through the light pipe when the roller is in rolling contact with the sensing feature of the rotatable gate.

18. A currency handling apparatus comprising:

a validation unit, the validation unit including a transportation mechanism for transporting an item of currency there through;

a currency storage unit for storing at least one item of currency determined to be acceptable by the validation unit;

a stacking mechanism for stacking the at least one item of currency in the currency storage unit;

a stacking drive assembly for actuating the stacking mechanism to stack the at least one item of currency in the currency storage unit, the stacking drive assembly being actuatable in first and second directions;

a security gate mechanism operatively coupled between the stacking mechanism and the stacking drive assembly, the security gate mechanism including a rotatable gate having a slit therein, wherein the slit is aligned with the currency passageway when the rotatable gate is in an initial position, a drive wheel coupled to the rotatable gate and the stacking drive assembly for driving the rotatable gate in the first and second directions, wherein the second direction is opposite the first direction, a positioning member selectively engageable with the drive wheel for positioning the rotatable gate in the initial position such that the slit in the rotatable gate is substantially aligned with the passageway, wherein the positioning member is arranged to be engageable with the drive wheel when the drive wheel rotates the rotatable gate in the second direction and not engageable with the drive wheel when the drive wheel rotates the rotatable gate in the first direction.

19. The currency handling apparatus of claim 18 wherein the drive wheel comprises a toothed gear having a step gear incorporated thereon, and wherein the currency handling apparatus further comprises a positioning gear meshingly coupled with the drive wheel and including a positioning cam surface thereon.

20. The currency handling apparatus of claim 19 wherein the positioning member includes a cam follower surface for sliding engagement with the positioning cam surface of the positioning gear.

21. The currency handling apparatus of claim 20 wherein the positioning cam surface is a variable radius surface relative to a rotational axis of the positioning gear.

22. The currency handling apparatus of claim 21 wherein the positioning member is moved from a blocking position to a non-blocking position when the positioning gear is rotated in the first direction.

23. The currency handling apparatus of claim 20 wherein the positioning cam surface includes a positioning gear abutment surface and the positioning member includes a positioning member abutment surface.

24. The currency handling apparatus of claim 23 wherein the rotatable gate is positioned in the initial position when the positioning gear abutment surface and the positioning member abutment surface are in abutment, and wherein the rotatable gate is positioned in the initial position by movement of the positioning gear in a second direction whereby the positioning gear abutment surface and the positioning member abutment surface are brought into abutment.

* * * * *